US006658903B1

(12) United States Patent
McShane et al.

(10) Patent No.: US 6,658,903 B1
(45) Date of Patent: Dec. 9, 2003

(54) THERMALLY INSULATED LOCK BOX AND LOCK THEREFOR

(76) Inventors: James P. McShane, 4572 Darcie Dr., Erie, PA (US) 16506; Gregory L. Hess, 1043 Rankine Ave., Erie, PA (US) 16511; Marshall R. Mooney, 9988 Smith St., Lake City, PA (US) 16423

( * ) Notice: Subject to any disclaimer, the term of this patent is extended or adjusted under 35 U.S.C. 154(b) by 227 days.

(21) Appl. No.: 09/670,943

(22) Filed: Sep. 27, 2000

(51) Int. Cl.[7] ..... B65D 55/14

(52) U.S. Cl. ..... 70/63; 70/389; 109/65; 62/457.1

(58) Field of Search ..... 70/63, 158–173, 70/389; 109/1 S, 45, 51, 58–59 R, 64, 65, 68, 74, 84; 604/408, 410; 62/457.1–457.5, 371, 530; 206/364, 365, 1.5, 828

(56) References Cited

U.S. PATENT DOCUMENTS

| | | | | | |
|---|---|---|---|---|---|
| 2,780,088 | A | * | 2/1957 | Nabeit | 70/389 X |
| 3,338,068 | A | * | 8/1967 | Piker | 62/371 |
| 3,789,636 | A | * | 2/1974 | Nakashima | 70/389 X |
| 4,145,895 | A | * | 3/1979 | Hjertstrand et al. | 62/457.1 X |
| 4,228,908 | A | * | 10/1980 | Tweeton | 206/545 X |
| 4,250,998 | A | * | 2/1981 | Taylor | 62/371 X |
| 4,292,817 | A | * | 10/1981 | Loucks | 62/457.1 |
| 4,425,998 | A | * | 1/1984 | Hof et al. | 62/371 X |
| 4,498,312 | A | * | 2/1985 | Schlosser | 62/457.1 |
| 4,528,829 | A | * | 7/1985 | Bert et al. | 70/389 |
| 4,641,509 | A | * | 2/1987 | Batchelor et al. | 70/389 X |
| 4,892,226 | A | * | 1/1990 | Abtahi | 62/457.1 |
| 4,932,533 | A | * | 6/1990 | Collier | 206/569 |
| 5,009,088 | A | * | 4/1991 | Cislo | 70/63 |
| 5,103,651 | A | * | 4/1992 | Coelho et al. | 62/457.2 X |
| 5,172,575 | A | * | 12/1992 | Fisher | 70/63 |
| 5,238,112 | A | * | 8/1993 | Massey et al. | 70/63 X |
| 5,295,447 | A | * | 3/1994 | Robbins et al. | 109/65 |
| 5,417,082 | A | * | 5/1995 | Foster et al. | 62/457.1 |
| 5,493,874 | A | * | 2/1996 | Landgrebe | 62/457.2 |
| 5,669,233 | A | * | 9/1997 | Cook et al. | 62/371 |
| 5,689,970 | A | * | 11/1997 | Chopas | 62/457.2 X |
| 5,713,224 | A | * | 2/1998 | Liou | 70/389 X |
| 5,758,513 | A | * | 6/1998 | Smith | 62/457.5 |
| 5,956,968 | A | * | 9/1999 | Grabowski | 62/457.2 |
| 5,970,889 | A | * | 10/1999 | Shaffer et al. | 109/65 |
| 6,006,558 | A | * | 12/1999 | Peters | 70/63 |
| 6,067,813 | A | * | 5/2000 | Smith | 62/371 |
| 6,354,104 | B1 | * | 3/2002 | Feagin | 62/457.1 |
| 6,361,746 | B1 | * | 3/2002 | Wlodarski | 62/371 X |
| 6,427,475 | B1 | * | 8/2002 | DeFelice et al. | 62/457.2 |

* cited by examiner

*Primary Examiner*—Suzanne Dino Barrett
(74) *Attorney, Agent, or Firm*—Richard K. Thomson

(57) ABSTRACT

A pickup drop off lock box for medical samples is equipped with a failsafe lock which will not permit the key to be removed without the lid properly positioned to permit latching. Adequate thermal insulation is provided to allow samples to be stored at temperatures of 5° F. for 16 hours. In addition, an inner liner of styrene insulation is removable/replaceable in the event it becomes worn, soiled or damaged. The failsafe lock has potential applicability in other environments.

11 Claims, 3 Drawing Sheets

THERMALLY INSULATED LOCK BOX AND LOCK THEREFOR

BACKGROUND AND SUMMARY OF THE INVENTION

The present invention is directed to a lock box that is thermally insulated to permit medical samples, and the like, to be securely and safely stored for pickup for periods of 8 hours and more. More particularly, the present invention is directed to a lock box equipped with a failsafe lock which will not permit the key to be removed unless the lock elements are securely engaged.

Medical storage boxes have been produced by the assignee of the present invention, and others, for some time. These boxes are used for storing medical samples (blood, urine, etc.) for limited periods of time outside the offices to provide a courier from an analysis lab, for example, after-hour access to pick up the samples. Legislation approved by the California Senate (Senate Bill #765) requires reporting of any incidents of unlocked specimen boxes. It is therefore desirable to provide a failsafe lock mechanism in which the key cannot be removed from the lock unless the lock elements are properly engaged. In addition, it is desirable to provide a lock box which can store frozen samples for periods of 16 hours at temperatures below 30° F., as low as 5° F. Lastly, the styrene (or styrofoam) insulation used to line the lock box is subject to abuse as a result of insertion and removal of the stored items. It is therefore desirable to provide a separable liner which can be removed and replaced should the inner liner become worn, soiled or damaged.

The present invention addresses these concerns by providing a storage box for heat-sensitive sample containers comprising a generally rectangular enclosure defined by an outer peripheral wall of rigid material, said enclosure having four lateral walls, a bottom wall and a top wall which is pivotally attached to one of said four lateral walls; at least one layer of insulation lining an inner portion of each of said four lateral walls, said bottom wall and said top wall; a fail-safe, key-operated lock having a first member associated with said top wall and a second member associated with a second one of said lateral walls, said lock precluding a key from being removed from said lock unless said first member and said second member are in interlocking engagement; whereby said sample containers may be locked in said storage box with at least one freezable packet, said insulation having sufficient thickness to maintain a temperature of the heat-sensitive sample containers below a desired maximum temperature for at least eight hours regardless of an ambient temperature surrounding said box. The rigid material making up the outer peripheral wall is preferably sheet metal that is coated with a protective coating such as an enamel paint. Further, it is preferred that the box has adequate interior volume to accommodate at least one soft-sided, insulated satchel that can be removed with their refrigerated contents. The innermost liner of styrene is held in by a fiction fit and may be easily removed and replaced in the event of wear, soiling or damage.

The failsafe lock preferably comprises a cam cylinder associated with a first one of said top wall and said second lateral wall, said cam cylinder having a first latching means attached thereto and being operable by said key, said cam cylinder being oscillatable by said key between a first latched position and a second unlatched position; a second latch means associated with another of said top wall and said second lateral wall; a spring associated with the same one of said top wall and said second lateral wall as said cam cylinder and engaging a portion of said cam cylinder disabling its rotation to a position where said key could be removed therefrom; a push bar associated with said another one of said top wall and said second lateral wall for engaging said spring and moving it to a non-disabling position when said second latch means is positioned where it can be engaged by said first latch means; whereby said cam cylinder can only be rotated to a key-removable position when said top wall is closed so that said second latch means can be engaged by said first latch means. While this lock has been designed for use with a medical sample lock box, it will have general utility with other applications where it is desirable to ensure securement of a lock prior to withdrawal of a key.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENTS

Figure 1:
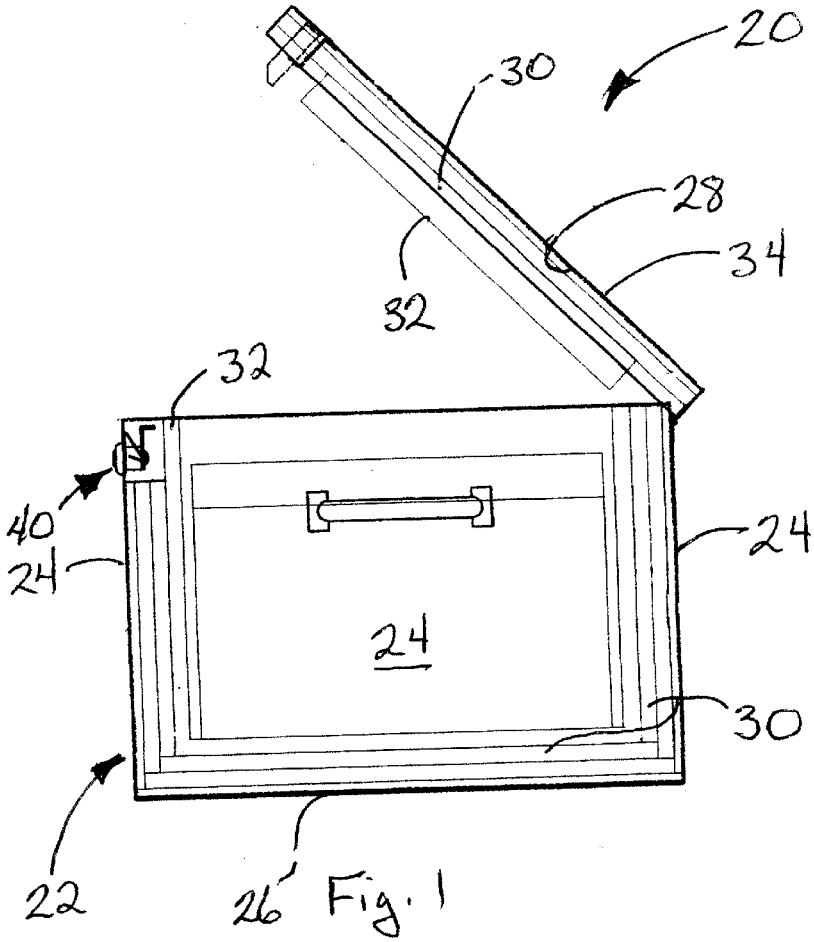
FIG. 1 is a side view of a first embodiment of the lock box of the present invention.
Figure 2:
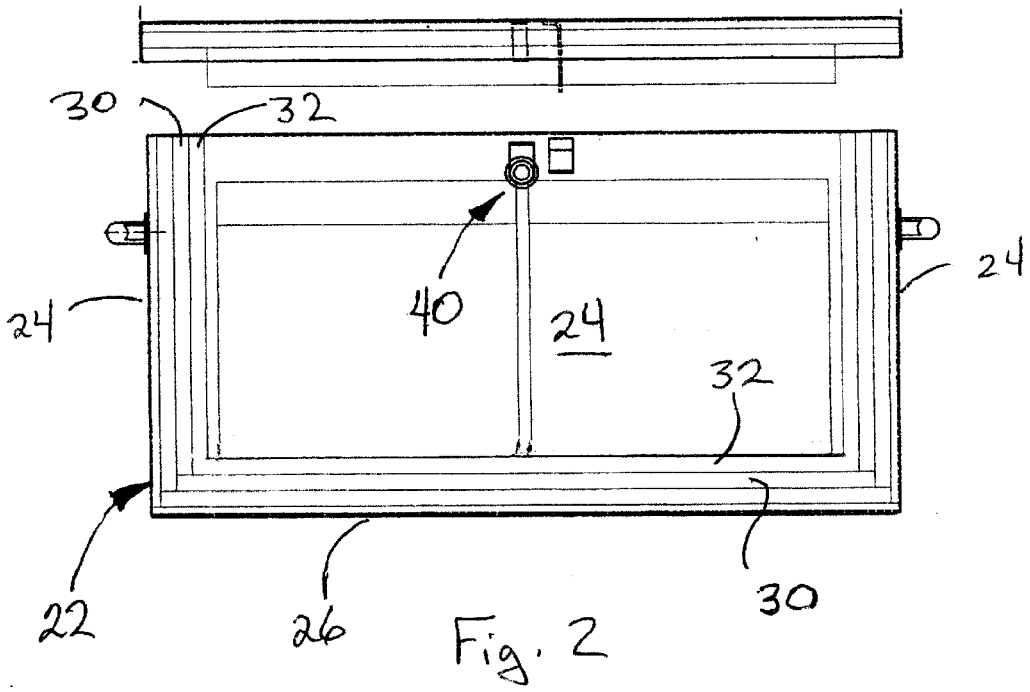
FIG. 2 is a front view of the first embodiment with the lid removed for clarity.

A first embodiment of the thermally insulated lock box for storing medical samples, and the like, is shown in FIG. 1 generally at 20. Lock box 20 comprises a generally rectangular enclosure 22 made of rigid material and having four lateral walls 24, a bottom wall 26 and a top wall formed by lid 28 which is pivotally attached to one of the lateral walls 24. Lid 28 is pivotally attached to a first lateral wall 24 to allow it to be raised to provide access to the enclosure 22. The rigid material is preferably sheet metal with each of the peripheral walls 24, 26, 28 having at least one layer 30 of thermal insulation. In fact, it is preferred that a second layer of insulation which may be styrene form an internal separable layer 32 retained by a friction fit and that can be removed and replaced in the event that it becomes worn, soiled or damaged.

Figure 4:
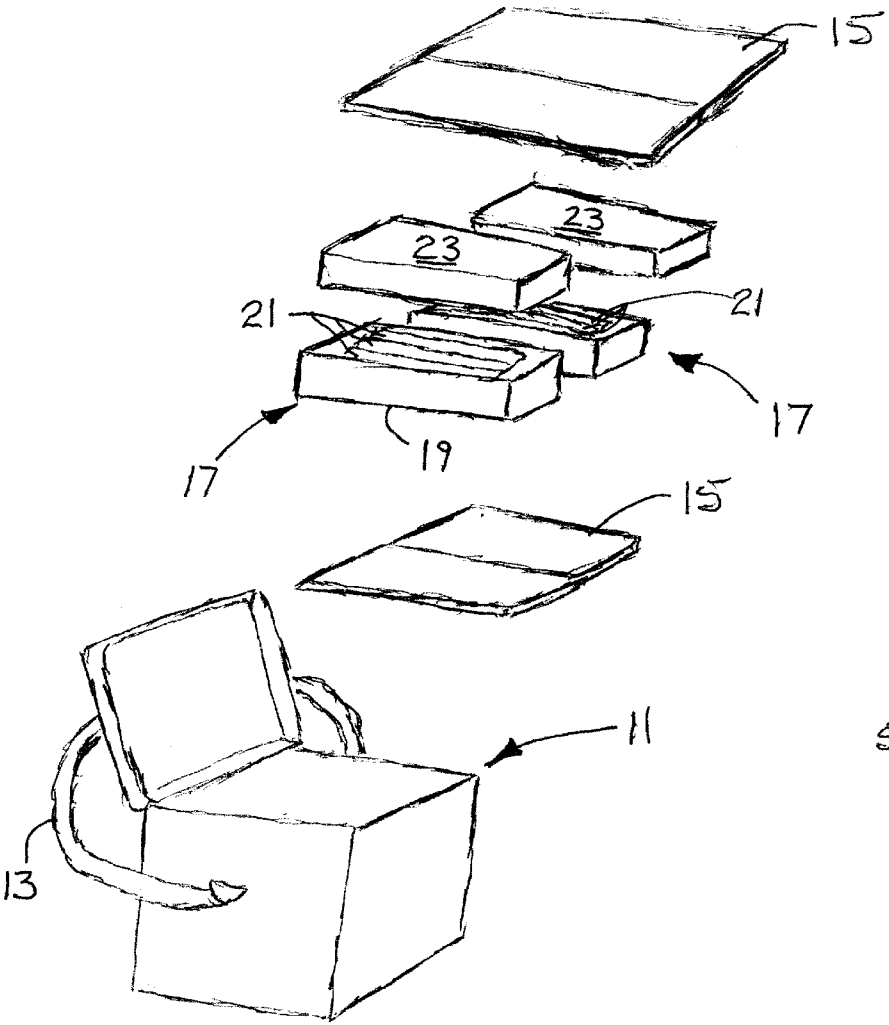
FIG. 4 is an exploded perspective view showing an exemplary carrier used with the lock box of the present invention.

As shown, lock box 20 can accommodate two removable carriers 11 (FIG. 4). Carriers 11 are preferably soft-sided coolers commercially available from a number of sources. Each carrier 11 has a shoulder strap 13 to enable ease of grasping and transport. Carrier 11 can be equipped with two freezable cooler packs 15 that can sandwich two medical vial securement boxes 17. Cooler packs 15 may alternatively be of a commercially available type capable of maintaining medical samples below 30° for extended periods up to 16 hours or of a second type capable of maintaining the samples below 5° for up to 16 hours. Each box 17 has a bottom 19 with a plurality of recesses 21 to receive conventional medical vials (not shown) and a top 23. Typically, the samples will be pre-frozen for transport and the box 17 will provide a limited amount of thermal insulation in addition to providing protection against jostling. Lock boxes 20 are also available in a single width version where sample volume does not warrant the larger box.

All exposed surfaces of enclosure 22 are preferably coated with a baked on enamel paint. This coating 34 will protect the surface of the enclosure 22, providing an attractive exterior, and will reflect a portion of the ultraviolet radiation striking the box 20 reducing the amount of thermal insulation needed to maintain a preferred maximum temperature within the enclosure 22. A layer of foil may also be used to line the interior of the box to reflect some of the ultraviolet radiation to avoid its penetration into the interior of enclosure 22.

Figure 3A:
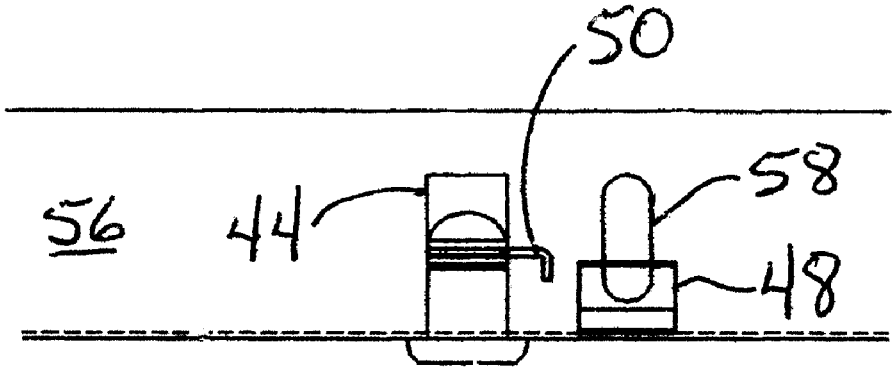
FIG. 3A is an enlarged top view of the locking mechanism of the present invention.
Figure 3B:
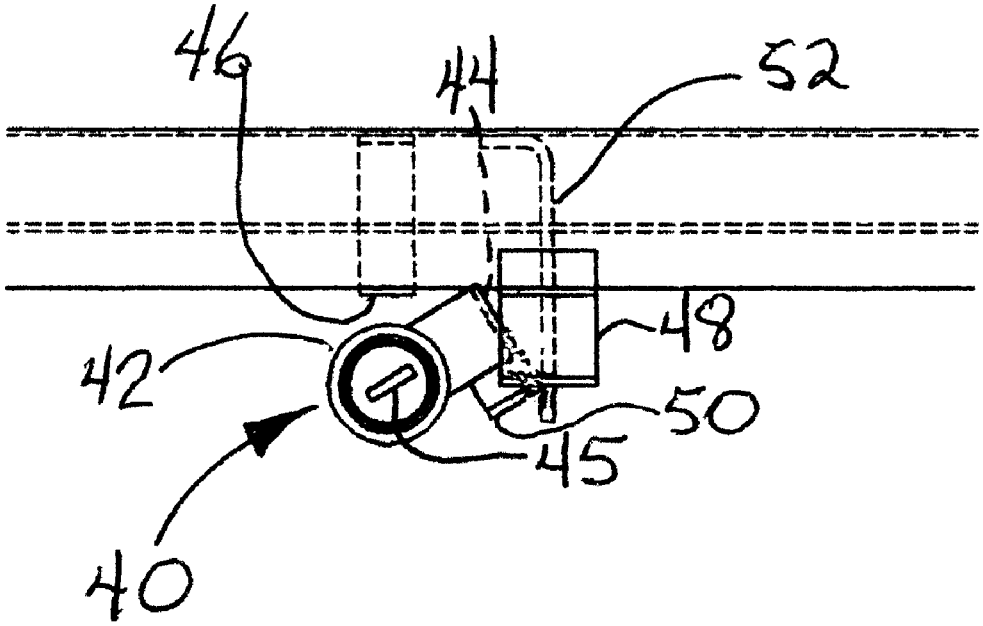
FIG. 3B is an enlarged front view of the locking mechanism of the present invention.
Figure 3C:
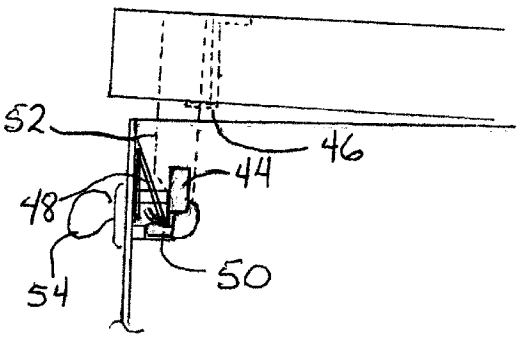
FIG. 3C is an enlarged side view of the locking mechanism of the present invention.

The failsafe lock device is best shown in FIGS. 3A–3C generally at 40. Fail-safe, key-operated lock comprises a cam cylinder 42 associated with a first one of the lid 28 and the second lateral wall 24. The cam cylinder 42 has a first latching means 44 attached thereto, the latching means 44 being operable by a key inserted into key slot 45 to rotate at least a portion of cam cylinder 42 between a first latched position and a second unlatched position. A second latch means 46 is associated with the other of the lid 28 and the second lateral wall 24. A leaf spring 48 associated with the first one of the lid 28 and the second lateral wall 24 (i.e., the same one as the cam cylinder) and engaging a portion 50 of the cam cylinder disabling its rotation to a position where said key 54 could be removed therefrom.

A push bar 52 associated with the second one of the lid 28 and the second lateral wall 24 for engaging spring 48 and moving it to a non-disabling position when the second latch means 46 is positioned where it can be engaged by the first latch means 44 securing the lid 28 in the closed position. In the embodiment shown in the figures, the push bar 52 and second latch means 46 are associated with lid 28 and cam cylinder 42 with first latch means 44 is associated with lateral wall and, are mounted beneath a inwardly directed flange 56. An oblong slot 58 permits push bar 52 access to leaf spring 48 to move it to a non-disabling position. Accordingly, the key 54 cannot be removed from the lock unless the lid 28 is latched shut. This will protect medical samples from possible tampering or unauthorized removal.

Various changes, alternatives and modifications will become apparent to one of ordinary skill in the art following a reading of the foregoing specification. It is intended that any such changes, alternatives and modifications as fall within the scope of the appended claims be considered part of the present invention.

We claim:

1. A lock box for storing heat-sensitive sample containers comprising a) a generally rectangular enclosure defined by an outer peripheral wall of rigid material, said enclosure having four lateral walls, a bottom wall and a top wall which is formed by a lid that is pivotally attached to one of said four lateral walls;

b) at least one layer of insulation lining an inner portion of each of said four lateral walls, said bottom wall and said top wall;

c) a fail-safe, key-operated lock having a first member associated with said top wall and a second member associated with a second one of said lateral walls, means within said lock for precluding a key from being removed from said lock unless said first member and said second member are in interlocking engagement;

whereby said sample containers may be locked in said storage box with at least one freezable packet, said insulation having sufficient thickness to maintain a temperature of the heat-sensitive sample containers below a desired maximum temperature for at least eight hours regardless of an ambient temperature surrounding said box.

2. The lock box of claim 1 further comprising an adequate inner volume to accommodate two removable, insulated soft-sided satchels which can each house a plurality of the sample containers.

3. The lock box of claim 1 further comprising a separate insulative liner providing said box with additional cooling capability, said separate insulative liner being readily replaceable should it become worn, soiled or damaged.

4. The lock box of claim 1 wherein said rigid material comprises sheet metal.

5. The lock box of claim 4 wherein said sheet metal is covered with a protective coating.

6. The lock box of claim 1 wherein the heat-sensitive sample containers are maintained at a temperature below 30° F. for a period of 16 hours.

7. The lock box of claim 6 wherein the heat-sensitive sample containers are maintained at a temperature of 5° F. for the 16 hour period.

8. The storage box of claim 1 wherein said fail-safe, key-operated lock comprises a) a cam cylinder associated with a first one of said top wall and said second lateral wall, said cam cylinder having a first latching means attached thereto and being operable by said key, said cam cylinder being oscillatable by said key between a first latched position and a second unlatched position;

b) a second latch means associated with another of said top wall and said second lateral wall;

c) spring means associated with the same one of said top wall and said second lateral wall as said cam cylinder for engaging and disabling rotation of a portion of said cam cylinder to a position where said key could be removed therefrom;

d) push bar means associated with said another one of said top wall and said second lateral wall for engaging and moving said spring means to a non-disabling position when said second latch means is positioned to be engaged by said first latch means;

whereby said cam cylinder can only be rotated to a key-removable position when said top wall is closed so that said second latch means can be engaged by said first latch means.

9. A fail-safe, key-operated lock comprising a) a cam cylinder associated with a first one of a first element to be locked together and a second element to be locked together, said cam cylinder having a first latching means attached thereto and being operable by said key, said cam cylinder being oscillatable by said key between a first latched position and a second unlatched position;

b) a second latch means associated with another of said first and said second elements to be locked together;

c) spring means associated with the same one of said first and said second elements to be locked together as said cam cylinder for engaging and disabling rotation of a portion of said cam cylinder to a position where said key could be removed therefrom;

d) push bar means associated with said another one of said first and said second elements to be locked together for engaging and moving said spring means to a non-disabling position when said second latch means is positioned to be engaged by said first latch means;

whereby said cam cylinder can only be rotated to a key-removable position when said first element to be locked together is positioned relative to said second element to be latched together so that said second latch means can be engaged by said first latch means.

10. A lock box for storing heat-sensitive sample containers comprising a) a generally rectangular enclosure defined by an outer peripheral wall of rigid material, said enclosure having four lateral walls, a bottom wall and a top wall which is pivotally attached to one of said four lateral walls;

b) a first fixed board layer of insulation lining an inner portion of each of said four lateral walls, said bottom wall and said top wall;

c) a second, removable board layer of insulative material positioned internally of said first layer, said second, removable layer including sections to protect each said fixed layer lining each of said four lateral walls, said bottom wall and said top wall;

whereby said second, removable layer of insulative material can be replaced should it become worn, soiled or damaged.

11. The lock box of claim 10 further comprising an adequate inner volume to accommodate two removable, insulated soft-sided satchels which can each house a plurality of the sample containers.

* * * * *